US005857392A

United States Patent [19]

Parkander

[11] Patent Number: 5,857,392

[45] Date of Patent: Jan. 12, 1999

[54] CUTTING DEVICE FOR CUTTING CONTINUOUS WEBS

[75] Inventor: Göthe Anders Krister Parkander, Ljungby, Sweden

[73] Assignee: Stralfors AB, Ljungby, Sweden

[21] Appl. No.: 743,863

[22] Filed: Nov. 5, 1996

[30] Foreign Application Priority Data

Nov. 6, 1995 [SE] Sweden ..... 9503875

[51] Int. Cl.[6] ..... B26D 5/00

[52] U.S. Cl. ..... 83/72; 83/76; 83/286; 83/331; 83/341; 83/370

[58] Field of Search ..... 83/72, 76, 286, 83/331, 340, 341, 342, 349, 369, 370, 301, 39, 42, 869

[56] References Cited

U.S. PATENT DOCUMENTS

| | | | |
|---|---|---|---|
| 2,249,820 | 7/1941 | Guilliksen . | |
| 2,599,430 | 6/1952 | Beuerman . | |
| 3,276,647 | 10/1966 | Lewis et al. . | |
| 3,334,795 | 8/1967 | Cockell . | |
| 3,581,613 | 6/1971 | Deems . | |
| 4,020,406 | 4/1977 | Tokuno et al. | 83/76 |
| 4,020,722 | 5/1977 | Byrt et al. . | |
| 4,196,648 | 4/1980 | Jones et al. . | |
| 4,449,433 | 5/1984 | Miyamoto | 83/76 |
| 4,781,090 | 11/1988 | Feldkamper et al. | 83/76 |
| 4,809,573 | 3/1989 | Welch | 83/76 |
| 5,186,090 | 2/1993 | Bunch, Jr. . | |

FOREIGN PATENT DOCUMENTS

| | | |
|---|---|---|
| 155240 | 3/1989 | Denmark . |
| 2120328 | 7/1972 | France . |
| 7207826 | 9/1973 | France . |
| 7305792 | 9/1974 | France . |
| 2289421 | 5/1976 | France . |
| 3836505 | 10/1988 | Germany . |
| 512300 | 10/1971 | Switzerland . |
| 1521345 | 8/1978 | United Kingdom . |
| 8201501 | 5/1982 | WIPO . |

OTHER PUBLICATIONS

European Search Report EP 96 11 7495.
Japanese Abstract 06085732.

*Primary Examiner*—M. Rachuba
*Attorney, Agent, or Firm*—Tarolli, Sundheim, Covell, Tummino & Szabo

[57] ABSTRACT

The present invention relates to a cutting device for cutting continuous webs, whereby a draw roller (29) with pulling surfaces (42) and a rotating cutting means (33) are rotatable by separate drive units (28 and 32 respectively) so that the speed of rotation of the draw roller (29) and the rotatable cutting means (33) can be varied relative to each other, whereby the relationship between the transport speed of the web and the speed of rotation of the rotatable cutting means (33) can be varied.

22 Claims, 7 Drawing Sheets

CUTTING DEVICE FOR CUTTING CONTINUOUS WEBS

FIELD OF THE INVENTION

The present invention relates to a cutting device for cutting continuous webs, which cutting device comprises at least one rotatably mounted transport means for transporting the continuous web in a transport direction towards at least two cooperating cutting means, which are adapted to cut the continuous web to sheets, whereby at least one rotatable cutting means has at least one cutting edge which is helically provided relative to a longitudinal centre line about which said rotatable cutting means rotates, while a fixed cutting means has a straight cutting edge, whereby the cutting means are provided so relative to each other that their cutting edges define a shear-type cutting device which is adapted to cut the continuous web to sheets along cutting lines that are provided in a right angle or substantially right angle relative to such an edge of the continuous web which runs in the longitudinal direction of said continuous web and in parallel with the transport direction, whereby a reading and control device is provided to read off certain positions of the continuous web and as a response thereto control the rotatably mounted transport means and the rotatably provided cutting means.

BACKGROUND OF THE INVENTION

Cutting devices of the abovementioned type are already known from e.g. DE, A1,3 836 505, but these prior art cutting devices do not permit quick and easy variation of the speeds of the web and cutting means relative to each other.

The object of the present invention has been to provide a cutting device of the abovementioned type which eliminates said problem.

Using a cutting device constructed in accordance with the present invention, it is possible to quickly and by simple means vary the speeds of the web and cutting means relative to each other and thereby obtain a cutting device with advantageous properties.

The object of the invention is also to achieve that the initially defined cutting device permits cutting of continuous webs irrespective of whether said webs have edge perforations or not.

BRIEF DESCRIPTION OF THE DRAWINGS

The invention will be further described below with reference to the accompanying drawings, wherein.

DETAILED DESCRIPTION OF A PREFERRED EMBODIMENT

Figure 1:
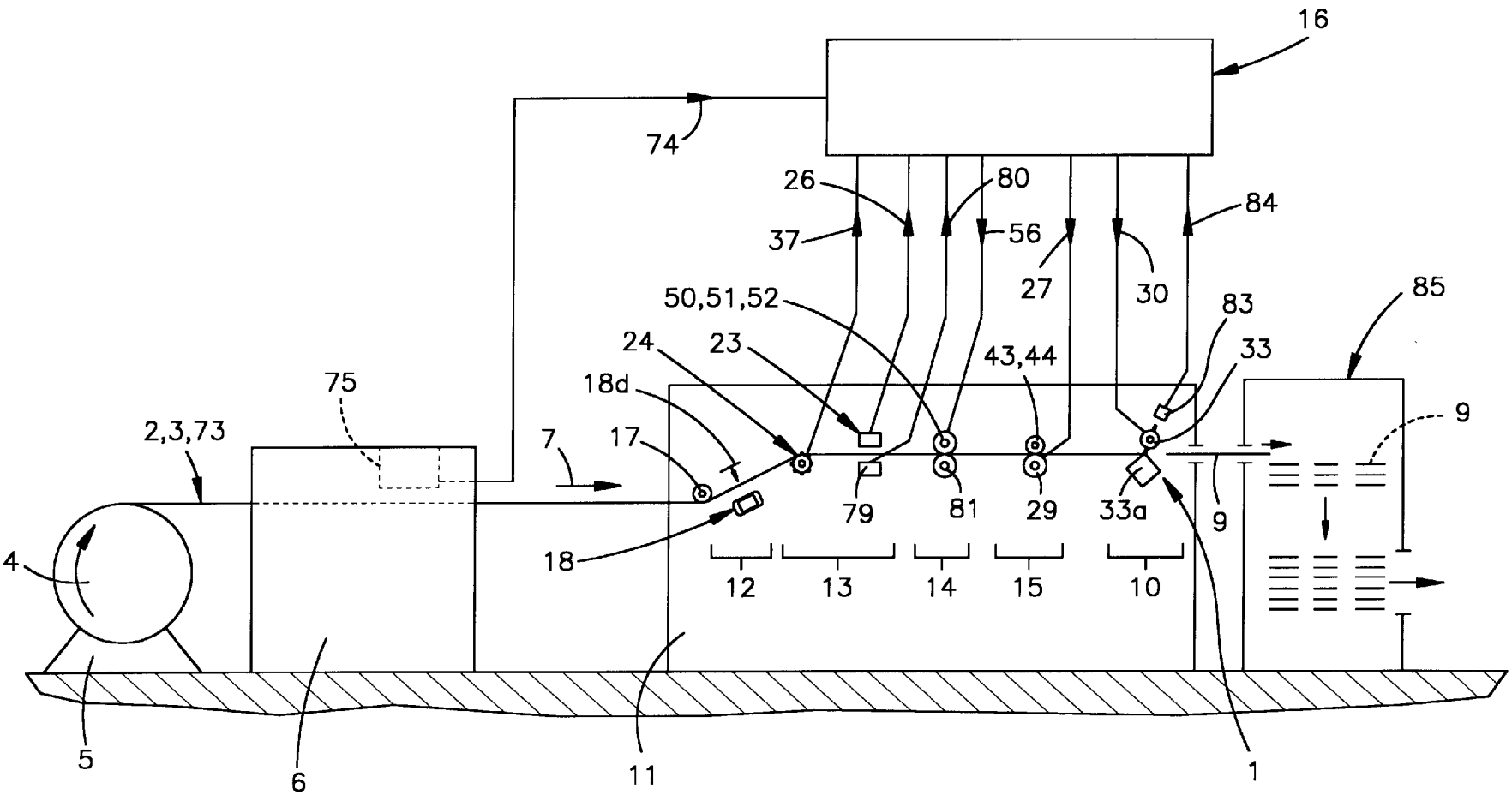
FIG. 1 is a schematic lateral view of a cutting device according to the invention located online with a high-speed printer.
Figure 2:
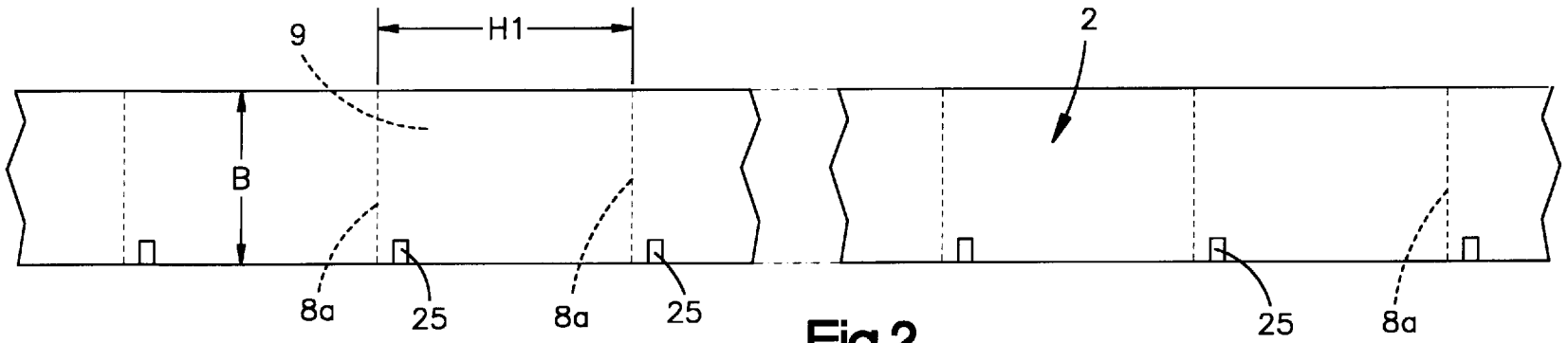
FIGS. 2 and 3 schematically illustrate two different types of continuous webs which can be cut in the cutting device of FIG. 1.
Figure 3:
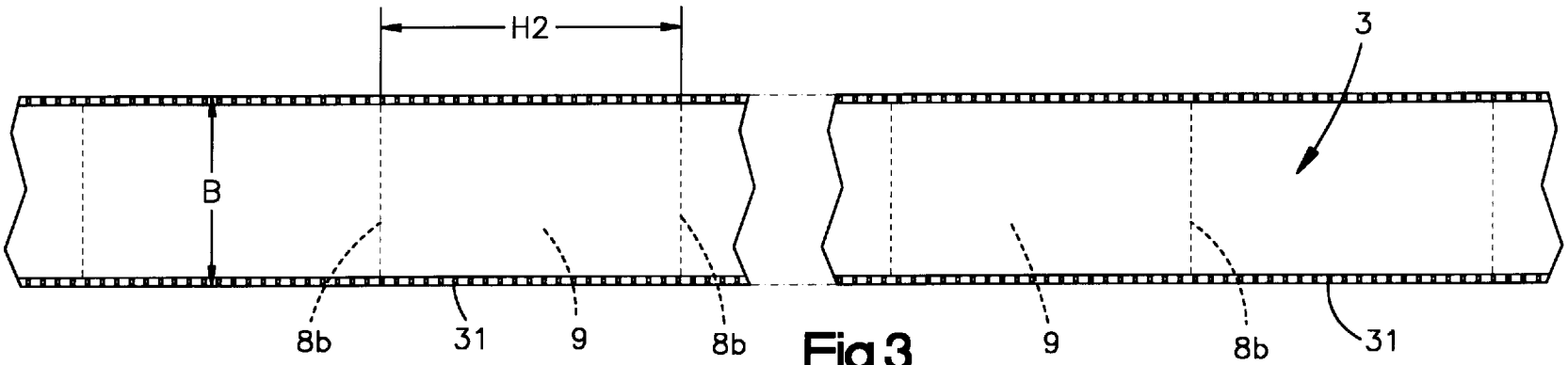

The cutting device 1 illustrated in the drawings is adapted to cut continuous webs 2 and 3 respectively, proceeding from a roll 4 in a schematically illustrated unrolling stand 5 and transported or fed through a high-speed printer 6, e.g. a laser printer, for printing. After the high-speed printer 6, the web 2 and 3 respectively is transported in printed condition in a transport direction according to arrow 7, to the cutting device 1 for cutting therein along cutting lines 8*a* or 8*b* (indicated with broken lines in FIGS. 2 and 3) to sheets 9. The width B of the sheets 9 corresponds with the width or half the width of the web 2 and 3 respectively, and the height H1 or H2 of the sheets 9 may vary as required.

The cutting device 1 forms part of a cutting station 10 in a machine unit 11, which also includes a plurality of other stations, namely a control station 12 to ensure that the web 2 and 3 respectively is transported in a predetermined lateral position relative to subsequent stations, a reading station 13 for reading of the momentaneous position of the web 2 and 3 respectively relative to the cutting device 1, a length cutting station 14 for eventual cutting of the web 2 and 3 respectively in several webs or for cutting off edge portions from said web 2 and 3 respectively, and a transport station 15 for pulling the web 2 and 3 respectively in the transport direction 7 and feeding it to the cutting device 1.

A reading and control device 16 is provided to read off momentaneous positions of the web 2 and 3 respectively relative to the cutting device 1 and, as a response to reading values displayed in the reading station 13, to generate control signals for controlling various units on subsequent stations.

The web 2 and 3 respectively is transported from the high-speed printer 6 in the transport direction 7 to the machine unit 11 and via a conducting roller 17 to the control station 12. The control station includes a lateral guide means 18 which is adapted to influence the web 2 and 3 respectively in such a lateral direction (arrow 19) relative to its transport direction 7 that one longitudinal edge 20 thereof is brought to cooperate with a guide bar 21, which ensures that the web 2 and 3 respectively thereafter is transported in a predetermined lateral position relative to the width B1 of a subsequent transport path 22 for said web through subsequent stations.

The lateral guide means 18 preferably includes an endless belt 18*a* which runs over two conducting wheels 18*b*, 18*c* and which engages the underside of the web 2 (or 3), whereby such frictional forces are generated in the contact surfaces between the belt 18*a* and the web 2 that said belt 18*a* affects said web 2 in a direction towards the guide bar 21. The web 2 preferably may be pressed from above against the belt 18*a* by means of suitable pressure means 18*d*, e.g. steel balls which engages the web 2 from above.

The abovementioned cutting lines 8*a*, 8*b* are provided to extend at a right or substantially right angle relative to the longitudinal edge 20 of the continuous web 2 and 3 respectively, and said edge is provided to run in parallel with the transport direction 7 of said web.

The reading station 13 includes at least a first reading means 23 and a second reading means 24. The first reading means 23 is provided to cooperate with webs 2 of said first type, i.e. webs 2 with cutting information signs 25 but without edge perforations. Thus, the reading means 23 cooperates with the web 2 in such a way that said reading means detects when said cutting information signs 25 pass and feeds as a response thereto, reading values (symbolized by arrow 26) to the reading and control device 16. The reading and control device 16 generates control signals (symbolized by arrow 27) as a response to the reading values received, for controlling a drive unit 28 for rotation of a rotatably mounted pull means in the form of a draw roller 29 at the transport station 15. The draw roller 29 is mounted to rotate with such a speed of rotation that it pulls the web 2 towards it and feeds said web towards the cutting means 33, 33*a* with a transport speed that is dependent on said control signals. The reading and control device 16 also generates control signals (symbolized by arrow 30) which, as a response to the reading values 26 received, control a drive unit 32 forming part of the cutting device 1 for rotating a rotatably mounted cutting means 33 with such a cutting speed that the web 2 (or 3) is cut along the predetermined cutting lines 8*a* or 8*b* to sheets 9 with a suitable height H1 (web 2) or H2 (web 3). The drive unit 32 may consist of an electrically operated stepping motor which is controlled by control signals 30 in the form of control pulses.

The draw roller 29 and the rotatable cutting means 33 respectively, are operated by separate drive units 28 and 32 respectively, which permit variation of the speeds of rotation of said draw roller 29 and said cutting means 33 relative to each other, whereby the relationship between the transport speed of the web 2 and 3 respectively and the cutting speed of the cutting means 33 may be varied.

The second reading means 24 of the reading station 13 is provided to cooperate with webs 3 of the latter type 3, i.e. webs 3 with edge perforations 31 but without cutting information signs 25. The reading means 24 consists of or includes a reading wheel 34 which is rotatably mounted and provided with protruding pins 35. These pins 35 engage the edge perforations 31 when the web 3 passes the reading wheel 34. Hereby, the web 3 affects the reading wheel 34 to rotate with a speed of rotation that is dependent on the transport speed of the web 3. The reading wheel 34 cooperates preferably with a pulse transducer 36 which generates reading values in the form of reading pulses 37 as a response to the rotary speed of the reading wheel 34 and these reading pulses (symbolized by arrow 37) generate control signals 27, 30 in the reading and control device 16 for controlling the drive units 28 and 32 respectively of the draw roller 29 and cutting means 33, so that the web 3 is cut in sheets 9 along the predetermined cutting lines 8*b* by means of the rotating cutting means 33.

Figure 4:
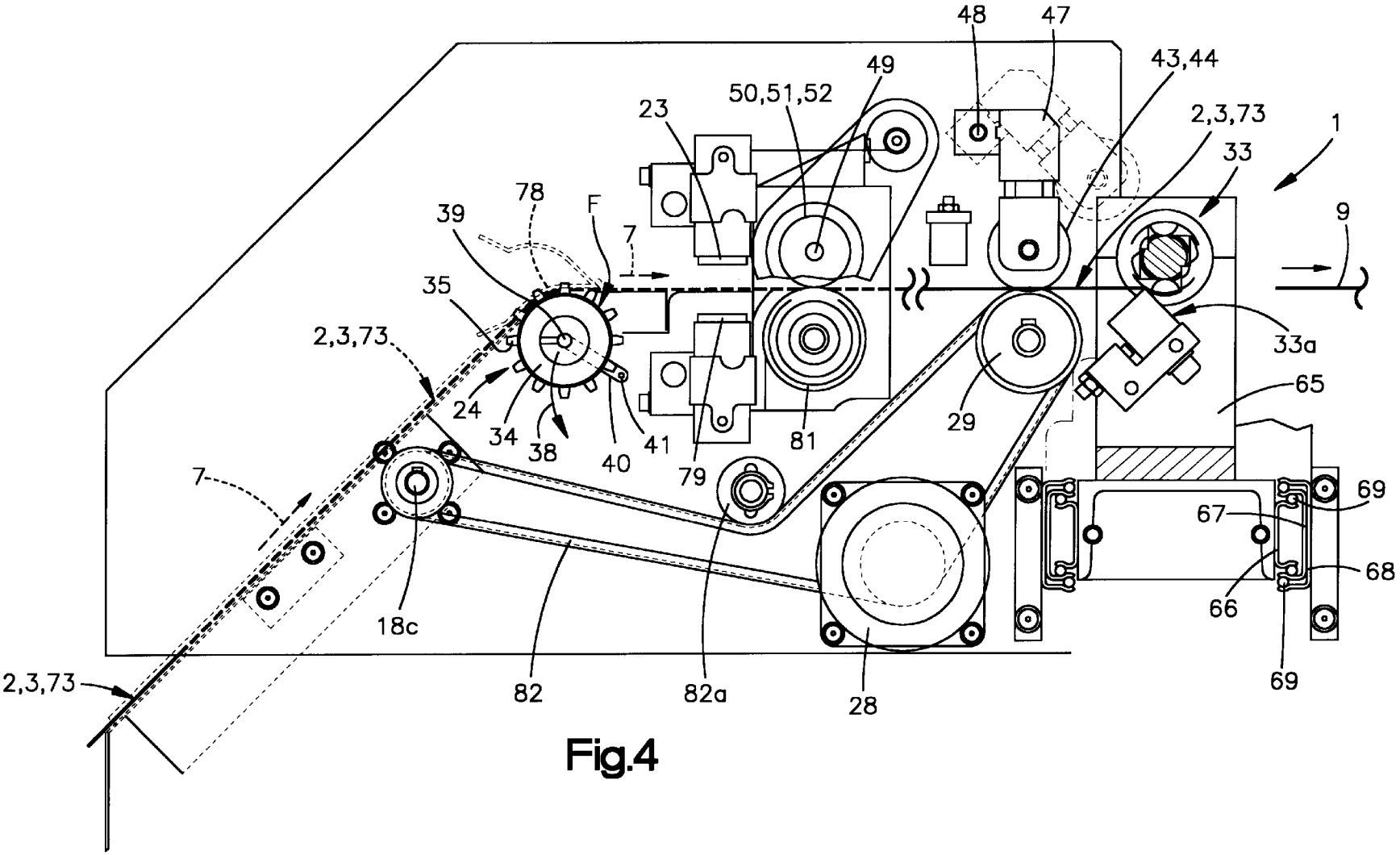
FIG. 4 is a lateral and partially sectional view of members of the cutting device of FIG. 1 in more detail.
Figure 5:
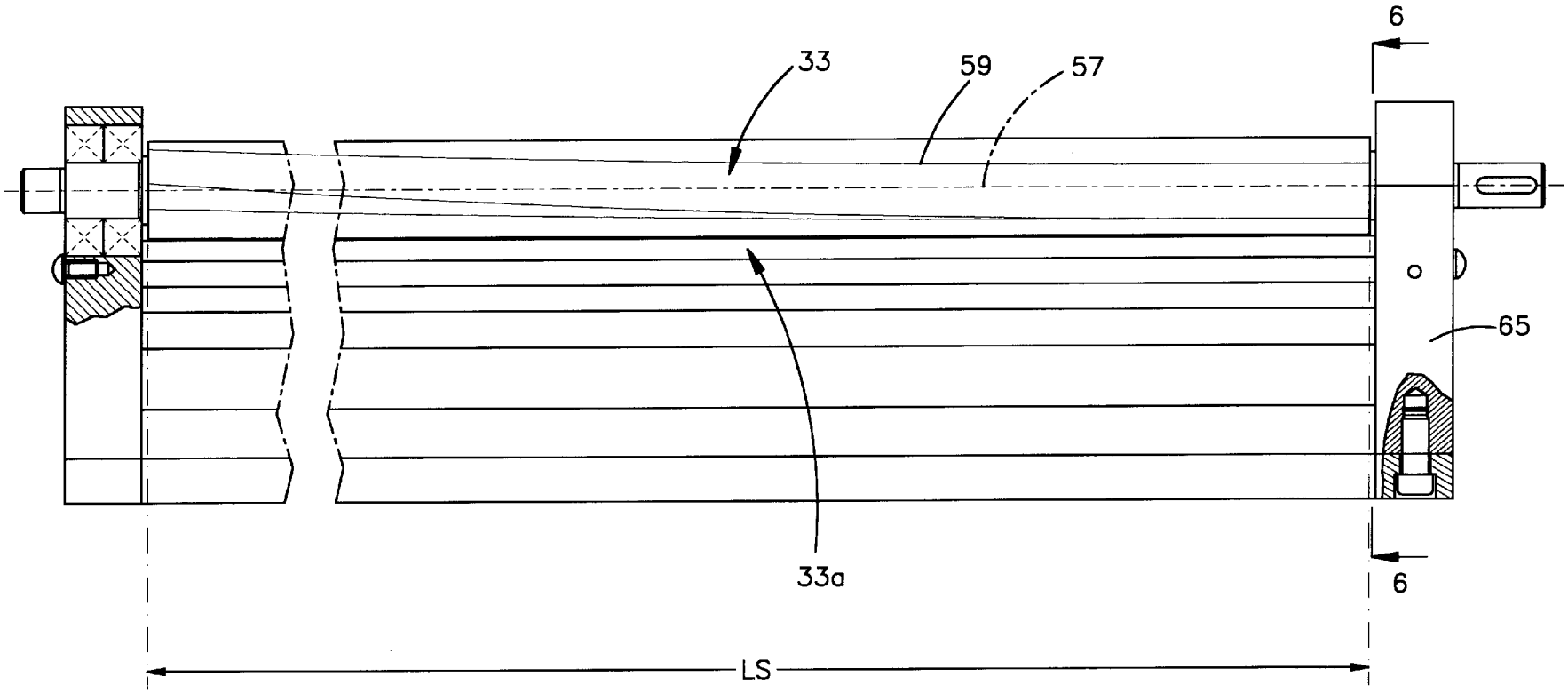
FIG. 5 is a front view of cutting means forming part of the cutting device of FIG. 1.
Figure 6:
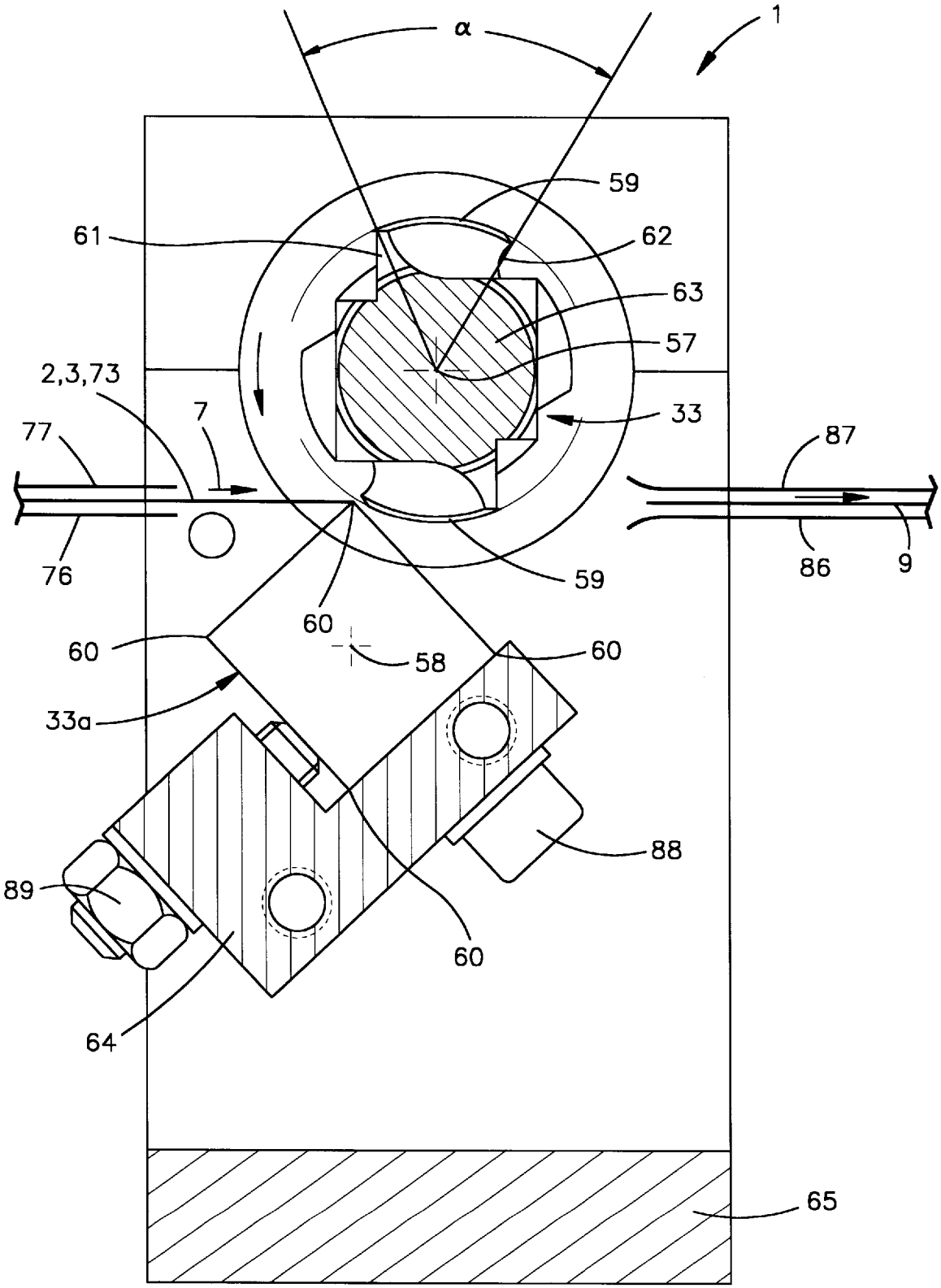
FIG. 6 is a section along the line VI—VI through the cutting means of FIG. 5.
Figure 7:
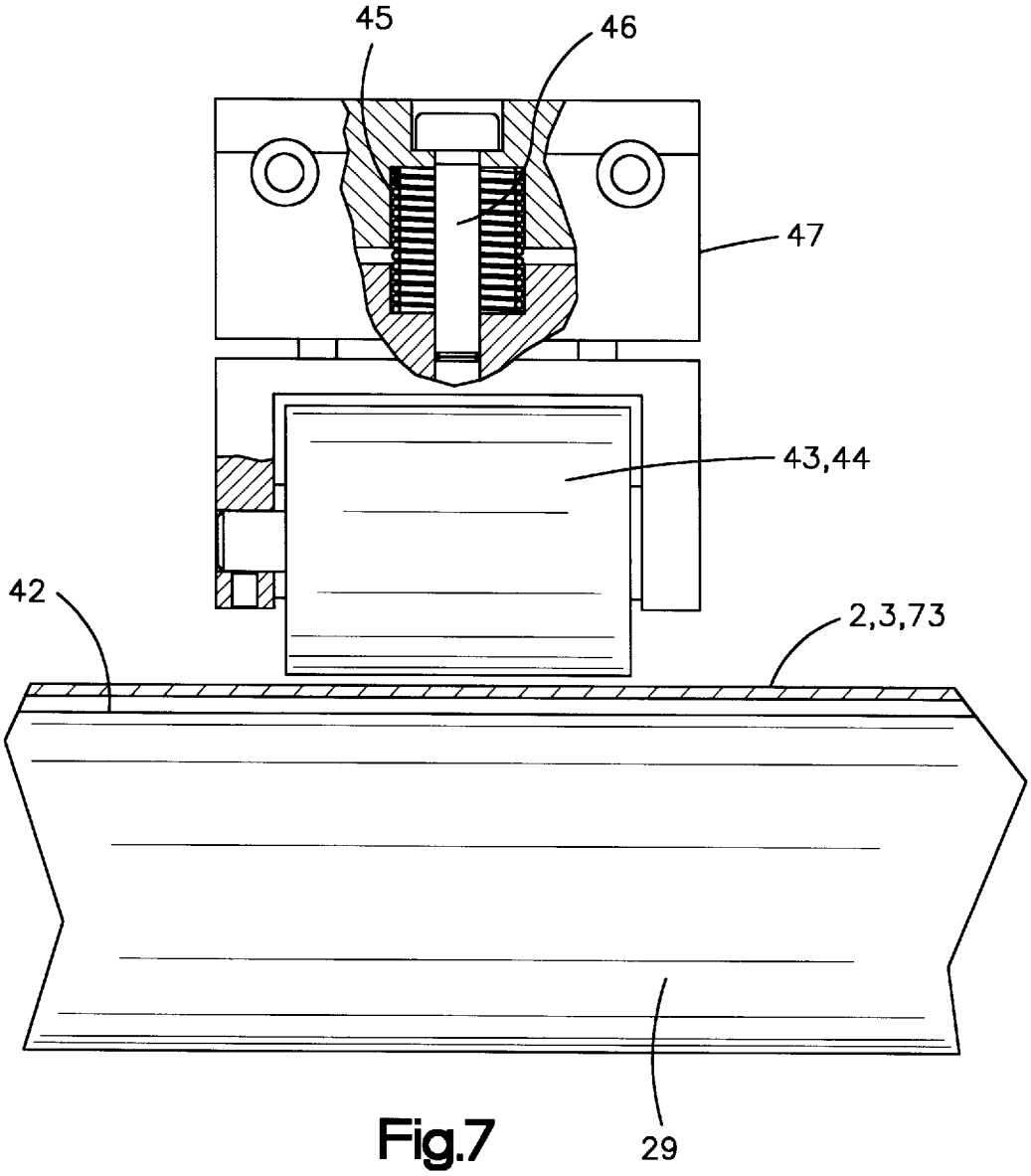
FIG. 7 is a front and partially sectional view of a printing wheel forming part of the cutting device of FIG. 4.
Figure 8:
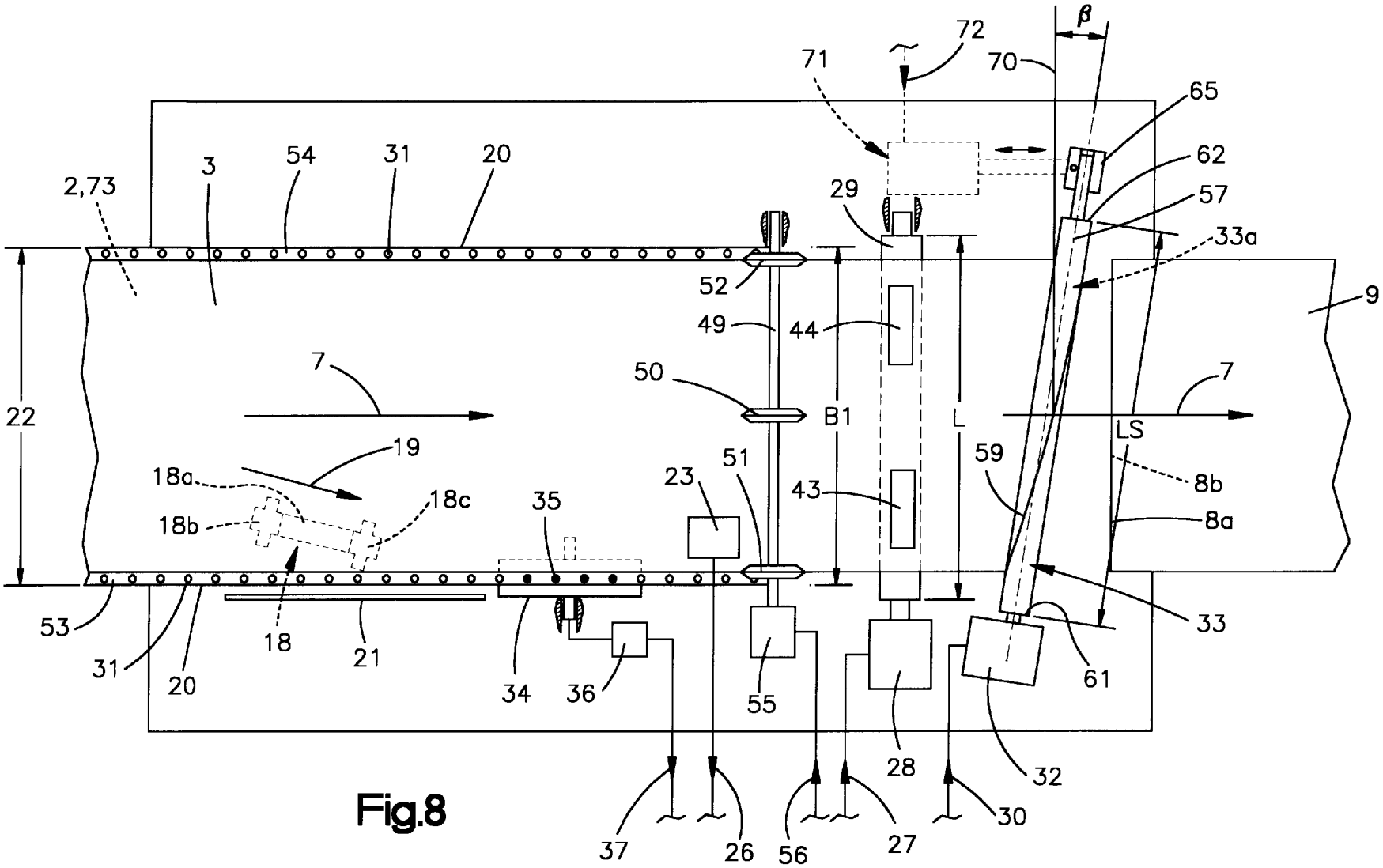
FIG. 8 is a schematic plan view of the cutting device according to the invention.

In order not to be in the way for webs 2 of the first type when these webs shall be cut to sheets 9 in the cutting device 1, the reading wheel 34 is preferably displaceably mounted so that it can be moved from an operating position F wherein it can cooperate with webs 3 of the second or other type (movement of the reading wheel 34 is indicated by arrow 38 in FIG. 4). Thus, a centre shaft 39 about which the reading wheel 34 rotates may be mounted on an arm 40 which is located radially relative to the reading wheel 34 and which is pivotally suspended on a shaft 41.

The draw roller 29 is cylindrical in shape and has pulling or drawing surfaces 42, the length L of which preferably corresponds with or is larger than the width B1 of the transport path 22, so that said pulling surfaces 42 can cooperate with the entire width B of the web 2 and 3 respectively. The pulling surfaces 42 are designed to permit the friction at the contact surface between said surfaces and the web 2 and 3 respectively to become sufficiently large for the draw roller 29 to draw or pull the web 2 and 3 respectively in the transport direction 7 with a predetermined speed and to feed said web to the cutting means 33 with a predetermined transport speed.

Above the draw roller 29 there are provided two or another suitable number of pressing wheels 43, 44 for pressing the web 2 and 3 respectively against the pulling surfaces 42 of the draw roller 29 with a sufficient force for providing said friction between said pulling surfaces 42 and said web. Each pressing wheel 43, 44 can cooperate with a pressure spring 45 which press the pressing wheel 43 and 44 respectively against the web 2 and 3 respectively and thereby, the web with a sufficient force against the draw roller 29. The force of the pressure spring in the direction towards the draw roller 29 can be varied with a setting means 46, e.g. a set screw.

Each pressing wheel 43, 44 and pressure spring 45 may be mounted on a bracket 47 which is pivotally suspended on a shaft 48, so that said pressing wheel 43, 44, when required, can pivot upwards from its operating position to an upper position (illustrated with broken lines in FIG. 4).

The length cutting station 14 comprises a shaft 49 which is located transversely relative to the transport direction 7 of the web 2 and 3 respectively. On this shaft 49 there is mounted a length cutting means 50 in the form of a rotatable knife or similar. This length cutting means 50 is adapted to cut the web 2 and 3 respectively in two web portions with the same or different widths. On the shaft 49 there may also be provided two further length cutting means 51, 52 which are adapted to cut the longitudinal edge of the web 2 and 3 respectively for removing edge strips 53, 54 thereof having edge perforations 31 (in FIG. 4 the length cutting means 51, 52 are in operation for cutting off said edge strips 53, 54).

The length cutting means 50 and/or the length cutting means 51, 52 is/are activated by means of a schematically illustrated drive unit 55 which is controlled by control signals (symbolized by an arrow 56) from the reading and control device 16.

The length cutting means 50, 51 and 52 may be moved upwards from their cutting positions if the continuous web 2 or 3 shall not be cut in its longitudinal direction.

At the cutting station 10, there is provided, except for the rotatable cutting means 33, a fixed cutting means 33*a*, whereby both cutting means 33, 33*a* are oriented so that their longitudinal centre lines 57 and 58 respectively run in transverse direction relative to the transport direction 7 of the web 2 and 3 respectively.

The rotatable cutting means 33 has two or another suitable number of cutting edges 59 which extend helically along the longitudinal centre line 57 and which cooperate with a straight cutting edge 60 which runs along the longitudinal centre line 58 of the fixed cutting means 33*a* in such a way that the cutting edges 59, 60 define a shear-type cutting device for cutting the web 2 or 3 to sheets 9.

The cutting edge 59 extends along the longitudinal centre line 57 so that it forms an angle of about 1° per cm with said centre line 57. Preferably, the helically provided cutting edge 59 has a length LS of 50–55 cm between opposite edge portions 61, 62 thereof and forms, seen from the side towards an edge portion 61, an angle $\alpha$ of 48°–52° between said edge portions 61, 62.

The rotatable cutting means 33 may include an elongated shaft 63 having two cutting edges 59 located thereon opposite each other. Each cutting edge 59 may be made integral with the elongated shaft 63 and may extend therealong as an elongated blade without transverse disruptions.

The fixed cutting means 33*a* is mounted on a bracket 64 and consists of an elongated bar having a four side, preferably square cross section. Due to this cross-sectional shape, the elongated bar defines four straight cutting edges 60 and said bar can be located in four different positions on the bracket 64 so that all four cutting edges 60 can be used.

The cutting means 33, 33*a* may be provided on a retaining device 65 which is mounted on guides 66–68 with intermediate roller bearings 69. The guides 66–68 are transversely located relative to the transport direction 7 of the web 2 and 3 respectively, and they permit lateral pulling of the retaining device 65 out of the machine unit 11 for facilitating replacement or adjustment of the cutting means 33, 33*a*.

The longitudinal centre line 57 of the rotatably mounted cutting means 33 forms an angle β with a transverse line 70 which is provided to extend at right angle or substantially right angle relative to the longitudinal edge 20 of the web 2 and 3 respectively, as well as the transport direction 7.

The angle β is dependent on the relationship between the transport speed of the continuous web 2 and 3 respectively, and the peripheral speed of the cutting edge 59 of the rotatable cutting means 33. The size of the angle β may vary, e.g. within a range of 1°–20°, whereby the size of said angle β increases with the transport speed, so that the cutting means 33, 33*a* cut the web 2 and 3 respectively to sheets 9 along said cutting lines 8*a* and 8*b* respectively. Hereby, the peripheral speed of the cutting edge 59 of the rotatable cutting means 33 can be lower than the peripheral speed which will be necessary if the longitudinal centre line 57 of the cutting means 33 extends in parallel with the transverse line 70.

Said angle β may eventually be altered during operation by means of a schematically illustrated angle setting unit 71 which is controlled by control signals 72 from the reading and control device 16, so that the angle β is altered as a response to alterations in the relationship between the transport speed of the web 2 and 3 respectively, and the peripheral speed of the cutting edge 59 of the rotatable cutting means 33.

The reading and control device 16 may also be provided to receive reading values 74 from a reading means 75 which is located in a separate unit, e.g. the unrolling stand 5 or the high-speed printer 6, upstream of the machine unit 11. The reading means 75 is provided to read off certain positions relative to the cutting means 33, 33*a* of a continuous web 73 of a third type, namely without cutting information signs 25 and without edge perforations 31, and the reading and control device 16 is provided to transmit control signals 27, 30 to the draw roller 29 and the rotatable cutting means 33 for rotation thereof in dependence of the determined reading values.

The cutting device illustrated in the drawings also comprises a lower and an upper guide rail 76, 77 for guiding the respective web 2, 3, 73 between the draw roller 29 and the cutting means 33, 33*a*. The reading station 13 includes a guide means 78 which ensures that the web 3 pass sufficiently close to the reading wheel 34 for the edge perforations 31 therein to cooperate with the pins 35 on said reading wheel 34. At the reading station 13, the first reading means 23 is mounted above the web 2 for reading or detecting cutting information signs 25 placed on the upper side of said web 2. At the reading station 13 there is also provided a third reading means 79 for detecting cutting information signs 25 or other signs on the bottom side of the web 2, whereby the values read, symbolized by arrow 80, are transmitted to the reading and control device 16. The length cutting station 14 can include at least one counter wheel 81 which is positioned under at least the length cutting means 50 and/or under the length cutting means 51, 52 and under the web 2, 3 and 73 respectively. The drive unit 28 can drive the draw roller 29 and the belt 18*a* by means of a drive belt 82 which runs over portions of said draw roller 29 and a conducting wheel 82*a* and cooperates with the conducting wheel 18*c*. The cutting station 10 may include a fourth reading means 83 for reading the momentaneous position of the cutting edges 59 and transmitting reading values, symbolized by arrow 84, to the reading and control device 16.

From the cutting station 10, the sheets 9 are transferred to a sorting device 85 wherein the sheets 9 are bundled and transported further. Between the cutting station 10 and the sorting device 85 there may be a lower and an upper guide rail 86, 87 for guiding the sheets 9 in vertical direction.

The invention is not limited to what is described above and illustrated in the drawings, but may vary within the scope of the subsequent claims. Thus, it should be mentioned that the webs 2, 3 and 73 can be fetched from other places than a roll 4 and a high-speed printer 6, and said webs can be preprinted or not. The webs 2, 3 and 73 may be of paper or another suitable material and said webs may be cut in equally long or, when required, differently long sheets 9. It should also be mentioned that the fixed cutting means 33*a* preferably is mounted on the bracket 64 by means of a retaining screw 88, so that it can be set relative to the movable cutting means 33 by means of a set screw 89.

I claim:

1. An apparatus for cutting a continuous web (2/3/73) having a longitudinal edge (20), said apparatus comprising:

cutting means (33, 33*a*) for cutting the continuous web (2/3/73) into individual sheets (9);

at least one rotatably mounted transport means (29) for transporting the continuous web (2/3/73) in a transport direction (7) along a transport path (22) at a transport speed toward said cutting means (33, 33*a*), said at least one rotatably mounted transport means comprising a draw roller (29), said cutting means (33, 33*a*) comprising at least one rotatable cutting means (33) and a fixed cutting means (33*a*), said at least one rotatable cutting means (33) rotating about a longitudinal centre line (57) and having at least one cutting edge (59) which extends helically relative to said longitudinal centre line (57), said fixed cutting means (33*a*) having a straight cutting edge (60), said at least one cutting edge (59) and said straight cutting edge (60) defining a shear-type cutting device for cutting the continuous web (2/3/73) into individual sheets (9) along cutting lines (8*a*, 8*b*) that extend at a right angle to the longitudinal edge (20) of the continuous web (2/3/73); and a reading and control device (16) for sensing the position and transport speed of the continuous web (2/3/73) and for controlling said draw roller (29) and said at least one rotatable cutting means (33) based on the sensed position and transport speed of the continuous web (2/3/73), said draw roller (29) and said at least one rotatable cutting means (33) being rotatable by separate rotary drive units (28 and 32, respectively) to permit variation of the rotational speed of said draw roller (29) and the rotational speed of said at least one rotatable cutting means (33) relative to each other so that variation between the transport speed of the continuous web (2/3/73) and the rotational speed of the rotatable cutting means (33) relative to one another is possible, said at least one rotatable cutting means (33) being operated by a rotary drive unit (32) comprising a motor which is controlled by pulsed control signals (30) from said reading and control device (16).

2. The apparatus according to claim 1 wherein said draw roller (29) has pulling surfaces (42) which frictionally engage the continuous web (2/3/73) to pull the continuous web (2/3/73) in the transport direction (7) and to feed the continuous web (2/3/73) to said cutting means (33, 33*a*), said longitudinal centre line (57) of said at least one rotatable cutting means (33) forming an angle (β) with a transverse line (70) which extends at a right angle to the transport direction (7), the magnitude of said angle (β) being dependent upon the relationship between the transport speed of the continuous web (2/3/73) and the peripheral speed of said at least one cutting edge (59) of said at least one rotatable cutting means (33) so that said cutting means (33, 33*a*) is able to cut the continuous web (2/3/73) into individual sheets (9) along the cutting lines (8*a*, 8*b*) when the peripheral speed of said at least one cutting edge (59) of said at least one rotatable cutting means (33) is lower than a required peripheral speed for cutting the continuous web (2/3/73) along the cutting lines (8*a*, 8*b*) as a result of said at least one rotatable cutting means (33) being located with said longitudinal centre line (57) in parallel with said transverse line (70).

3. The apparatus according to claim 2 wherein said draw roller (29) cooperates with at least one pressing wheel (43, 44) to press the continuous web (2/3/73) against said pulling surfaces (42) of said draw roller (29), said at least one pressing wheel being biased toward said draw roller (29) by a pressure spring (45).

4. The apparatus according to claim 3 wherein said pulling surfaces (42) of the draw roller (29) have a length (L) which is larger than a width (B1) of the transport path (22) along which the continuous web (2/3/73) is transported so that said pulling surfaces (42) cooperate with the entire width (B1) of the continuous web (2/3/73).

5. The apparatus according to claim 1 wherein said at least one cutting edge (59) of said at least one rotatable cutting means (33) has a length (LS) of 50–55 cm and extends at a helical angle (α) of 48°–52° between opposing edge portions (61 and 62) of said at least one cutting edge (59).

6. The apparatus according to claim 1 wherein said at least one rotatable cutting means (33) includes an elongated shaft (63) formed integrally with said at least one cutting edge (59).

7. The apparatus according to claim 1 wherein said at least one rotatable cutting means (33) has an elongated shaft (63), said at least one cutting edge (59) comprising two oppositely located cutting edges (59) mounted on said elongated shaft (63).

8. The apparatus according to claim 1 wherein said fixed cutting means (33*a*) comprises an elongated bar having four corners which define four straight cutting edges (60), said elongated bar being positionable in four different positions relative to said at least one rotatable cutting means (33) so that each of said four straight cutting edges (60) is operable to cut the continuous web (2/3/73) into individual sheets (9).

9. The apparatus according to claim 8 wherein said fixed cutting means (33*a*) has a square cross-section.

10. The apparatus according to claim 1 wherein said at least one cutting means (33, 33*a*) is mounted on a laterally extendable retaining device (65).

11. The apparatus according to claim 1 further comprising a guide bar (21) and at least one lateral guide means (18) for guiding the continuous web (2/3/73) in a lateral direction (19) relative to the transport direction (7) of the continuous web (2/3/73) such that the longitudinal edge (20) of the continuous web (2/3/73) cooperates with said guide bar (21) to ensure that the continuous web (2/3/73) is thereafter transported in a predetermined lateral position relative the transport path (22).

12. The apparatus according to claim 11 wherein said at least one lateral guide means (18) includes at least one driven endless belt (18*a*) extending over two conducting wheels (18*b*, 18*c*) and frictionally engaging the continuous web (2/3/73) to move the continuous web (2/3/73) toward said guide bar (21), said at least one driven endless belt (18*a*) and said draw roller (29) being driven by a common drive unit (28), one side of the continuous web (2/3/73) being pressed against said at least one driven belt (18*a*) by pressure means (18*d*) located on an opposite side of the continuous web (2/3/73).

13. The apparatus according to claim 1 further comprising at least one length cutting means (50/51, 52) for cutting the continuous web (2/3/73) into several longitudinally extending continuous web portions.

14. The apparatus according to claim 1 further comprising at least two guide rails (76, 77) between said draw roller (29) and said cutting means (33, 33*a*), one of said at least two guide rails (76) being underneath the continuous web (2/3/73) and another of said at least two guide rails (77) being above the continuous web (2/3/73) for guiding the continuous web (2/3/73) in a vertical direction between said draw roller (29) and said cutting means (33, 33*a*).

15. The apparatus according to claim 1 wherein said at least one cutting means (33) lies at a variable angle (β) defined between said longitudinal centre line (57) and a transverse line (70) extending at a right angle to the transport direction (7), said variable angle (β) increasing when the transport speed of the continuous web (2/3/73) increases and when the width of the continuous web (2/3/73) increases.

16. The apparatus according to claim 15 wherein the angle (β) between said longitudinal centre line (57) of said at least one rotatable cutting means (33) and said transverse line (70) is in the range of 1°–20°.

17. The apparatus according to claim 1 further comprising an angle setting unit (71) for pivoting said cutting means (33, 33*a*) so that an angle (β) between said longitudinal centre line (57) of said at least one rotatable cutting means (33) and a transverse line (70) which extends at a right angle relative to the transport direction (7) is variable in response to alterations of the relationship between the transport speed of the continuous web (2/3/73) and the peripheral speed of said at least one cutting edge (59) of said at least one rotatable cutting means (33).

18. An apparatus for cutting a continuous web (2/3/73) having a longitudinal edge (20), said apparatus comprising:

cutting means (33, 33*a*) for cutting the continuous web (2/3/73) into individual sheets (9);

at least one rotatably mounted transport means (29) for transporting the continuous web (2/3/73) in a transport direction (7) along a transport path (22) at a transport speed toward said cutting means (33, 33*a*), said at least one rotatably mounted transport means comprising a draw roller (29)

said cutting means (33, 33*a*) comprising at least one rotatable cutting means (33) and a fixed cutting means (33*a*), said at least one rotatable cutting means (33) rotating about a longitudinal centre line (57) and having at least one cutting edge (59) which extends helically relative to said longitudinal centre line (57), said fixed cutting means (33*a*) having a straight cutting edge (60), said at least one cutting edge (59) and said straight cutting edge (60) defining a shear-type cutting device for cutting the continuous web (2/3/73) into individual sheets (9) along cutting lines (8*a*, 8*b*) that extend at a right angle to the longitudinal edge (20) of the continuous web (2/3/73); and a reading and control device (16) for sensing the position and transport speed of the continuous web (2/3/73) and for controlling said draw roller (29) and said at least one rotatable cutting means (33) based on the sensed position and transport speed of the continuous web (2/3/73), said draw roller (29) being capable of transporting a first type (2) of continuous web without edge perforations (31) and a second type (3) of continuous web with edge perforations (31), said reading and control device (16) including a first reading means (23) for reading cutting information signs (25) on the first type (2) of continuous web and a second reading means (24) for reading the edge perforations (31) in the second type (3) of continuous web, said second reading means (24) being rotated by the edge perforations (31) in the second type (3) of continuous web.

19. The apparatus according to claim 18 wherein said second reading means (24) has a reading wheel (34) with radially protruding pins (35) which engage the edge perforations (31) in the second type (3) of continuous web so that said reading wheel (34), when the second type (3) of continuous web passes over said reading wheel (34), is brought to a speed of rotation which is dependent upon the transport speed of the continuous web (3).

20. The apparatus according to claim 19 further comprising a pulse transducer (36) which generates reading pulses (37) as a response to the speed of rotation of said reading wheel (34), which reading pulses (37) generate control signals (27, 30) in said reading and control device (16) for controlling said at least one rotatable cutting means (33) to cut the continuous web (3) into individual sheets (9) along the cutting lines (8*b*) as a response to said reading pulses (37).

21. The apparatus according to claim 19 wherein said reading wheel (34) is movable from an operating position (F) for transporting the second type (3) of continuous web to another position for transporting the first type (2) of continuous web.

22. The apparatus according to claim 18 wherein said reading and control device (16) is operable to receive reading values (74) from a third reading means (75) located in a separate unit (6) located upstream of said cutting means (33, 33*a*) and said draw roller (29), said third reading means (75) for reading the position relative to the cutting means (33, 33*a*) of a third type (73) of continuous web having neither cutting information signs (25) nor edge perforations (31).

* * * * *